US010542359B2

(12) United States Patent
Singer et al.

(10) Patent No.: US 10,542,359 B2
(45) Date of Patent: Jan. 21, 2020

(54) HEARING DEVICE

(71) Applicant: SIVANTOS PTE. LTD., Singapore (SG)

(72) Inventors: Erwin Singer, Eckental (DE); Christian Schmitt, Grossenseebach (DE); Benjamin Schmidt, Roethenbach an der Pegnitz (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/001,004

(22) Filed: Jun. 6, 2018

(65) Prior Publication Data

US 2018/0376263 A1 Dec. 27, 2018

(30) Foreign Application Priority Data

Jun. 21, 2017 (DE) ..... 10 2017 210 447

(51) Int. Cl.

| | |
|---|---|
| ***H04R 25/00*** | (2006.01) |
| ***H04R 1/10*** | (2006.01) |
| ***H01Q 1/22*** | (2006.01) |
| ***H01Q 1/27*** | (2006.01) |

(52) U.S. Cl.

CPC ..... *H04R 25/652* (2013.01); *H01Q 1/22* (2013.01); *H01Q 1/273* (2013.01); *H04R 25/55* (2013.01); *H04R 25/604* (2013.01); *H04R 25/70* (2013.01); *H04R 1/10* (2013.01); *H04R 2225/025* (2013.01); *H04R 2225/51* (2013.01)

(58) Field of Classification Search

CPC .. H04R 25/608; H04R 25/604; H04R 25/658; H04R 25/02; H04R 25/652; H04R 25/552; H04R 2225/023; H04R 25/554

USPC ..... 381/322

See application file for complete search history.

(56) References Cited

U.S. PATENT DOCUMENTS

| | | | | | |
|---|---|---|---|---|---|
| 3,852,540 | A | * | 12/1974 | Diethelm | H04R 25/60 381/324 |
| 4,716,985 | A | * | 1/1988 | Haertl | H04R 25/65 181/130 |
| 4,739,512 | A | * | 4/1988 | Hartl | H04R 25/65 381/324 |
| 4,791,819 | A | | 12/1988 | Goschke et al. | |

(Continued)

FOREIGN PATENT DOCUMENTS

| | | | |
|---|---|---|---|
| DE | 8518681 | U1 | 6/1986 |
| DE | 8706057 | U1 | 8/1988 |

(Continued)

*Primary Examiner* — Oyesola C Ojo

(74) *Attorney, Agent, or Firm* — Laurence A. Greenberg; Werner H. Stemer; Ralph E. Locher

(57) ABSTRACT

A hearing device that can be produced particularly efficiently has a housing, which can be inserted into an auditory canal of a person wearing the hearing device, and also a flexible retainer dome releasably fastened to the housing. The retainer dome serves to support the housing in the auditory canal. The housing has a one-piece housing shell and a face place. A structural unit with a receiver is disposed on the housing shell. The housing shell has a first, front-side opening, which is closed with the face plate, and a second, rear-side opening opposite the first opening. The structural unit protrudes from the rear-side opening with a retainer stub. The structural unit is fixed on the housing shell by a securing ring that is mounted externally onto the retainer stub.

14 Claims, 4 Drawing Sheets

(56) References Cited

U.S. PATENT DOCUMENTS 4,870,688 A * 9/1989 Voroba ..... G09B 21/009 381/60
4,969,534 A * 11/1990 Kolpe ..... H04R 25/456 181/130
5,347,584 A * 9/1994 Narisawa ..... H04R 25/602 381/323
6,144,749 A * 11/2000 Fideler ..... H04R 25/602 381/312
6,585,075 B1 * 7/2003 Gauthier ..... H04R 25/456 181/129
7,403,629 B1 7/2008 Aceti et al.
8,385,574 B2 * 2/2013 Aquilina ..... H04R 25/65 381/328
9,253,582 B2 * 2/2016 Nikles ..... H04R 25/65
9,467,761 B2 * 10/2016 Grinker ..... H04R 1/1058
9,521,494 B2 12/2016 Nikles
2001/0043708 A1 * 11/2001 Brimhall ..... H04R 25/456 381/328
2008/0170714 A1 * 7/2008 Major ..... H04R 25/60 381/87
2009/0123015 A1 * 5/2009 Saltykov ..... H04R 25/604 381/328
2010/0111348 A1 * 5/2010 Tsao ..... H04R 1/1016 381/380
2010/0260368 A1 * 10/2010 Heerlein ..... H04R 25/602 381/323
2014/0363037 A1 * 12/2014 Nikles ..... H01Q 1/22 381/328
2015/0146900 A1 * 5/2015 Vonlanthen ..... H01Q 1/273 381/322

FOREIGN PATENT DOCUMENTS

DE 1215711 A1 12/1992
DE 102009030552 * 12/2010 ..... H04R 25/00
DE 102009030552 B4 * 12/2010 ..... H04R 25/00
DE 102012211583 A1 8/2013
DE 102013210689 B3 10/2014
EP 0244671 A1 11/1987

* cited by examiner

HEARING DEVICE

CROSS-REFERENCE TO RELATED APPLICATION

This application claims the priority, under 35 U.S.C. § 119, of German patent application DE 10 2017 210 447.3, filed Jun. 21, 2017; the prior application is herewith incorporated by reference in its entirety.

BACKGROUND OF THE INVENTION

Field of the Invention

The invention relates to a hearing device with a housing that can be inserted into an ear of a person wearing the hearing device (who is also referred to hereinafter as the user). The invention relates in particular to an instant-fit hearing device in which the housing has a standard shape that is not adapted to an individual, wherein a flexible retainer dome with which the hearing device can be secured in the auditory canal is fitted onto the housing.

A hearing device serves to supply a hearing-impaired person with acoustic signals from the surroundings. The acoustic signals are suitably processed, in order to compensate the specific hearing impairment, and in particular amplified. To this end, a hearing device usually comprises an input transducer, for example in the form of a microphone, a signal processing unit with an amplifier, and an output transducer. The output transducer is generally realized as a miniaturized loudspeaker and is also referred to as a receiver. It in particular generates acoustic output signals which are fed to the auditory system of the patient and provide the latter with the desired auditory perception.

Different designs of hearing devices are offered in order to meet the great many individual requirements. In the case of BTE (behind-the-ear) hearing devices, a housing that contains components such as a battery and the signal processing unit is worn behind the ear. Depending on the design, the receiver can be arranged directly in the auditory canal of the wearer (receiver-in-canal (RIC) hearing devices) or, alternatively, the receiver is arranged inside the housing itself and a flexible sound tube guides the acoustic output signals of the receiver from the housing to the auditory canal. In the case of ITE (in-the-ear) hearing devices, a housing that contains all the functional components, including the microphone and the receiver, is worn at least partly in the auditory canal. CIC (completely-in-canal) hearing devices are similar to the ITE hearing devices but are worn completely in the auditory canal.

In a conventional design, an instant-fit hearing device comprises, for example, a housing shell closed by a face plate. The housing shell is divided lengthwise into two half-shells, wherein a sound outlet opening is formed on one of these half-shells at an inner end (i.e. directed toward the eardrum). The sound outlet opening has a joint head of a ball-and-socket joint, wherein the aforementioned flexible retainer dome can be plugged onto this joint head. The two housing shells are adhesively bonded to each other after assembly of the hearing-device components accommodated therein.

SUMMARY OF THE INVENTION

It is accordingly an object of the invention to provide a hearing device which overcomes the above-mentioned and other disadvantages of the heretofore-known devices and methods of this general type and to make available a hearing device that can be produced particularly efficiently.

With the foregoing and other objects in view there is provided, in accordance with the invention, a hearing device, comprising a housing configured for insertion into an auditory canal of a person wearing the hearing device;

said housing being a one-piece housing shell having a first, front-side opening, which is closed with a face plate, and a second, rear-side opening, which lies substantially opposite said first opening;

a structural unit including a receiver disposed in said housing shell, said structural unit protruding from said rear-side opening with a retainer stub;

a securing ring mounted externally onto said retainer stub, said securing ring fixing said structural unit on said housing shell; and a flexible retainer dome releasably fastened to said housing and configured to support said housing in the auditory canal;

In other words, the hearing device according to the invention comprises a housing, which can be inserted into an auditory canal of a person wearing the hearing device, and also a retainer dome fastened or fastenable to the housing and serving to support the housing in the auditory canal. The retainer dome is made of a flexible material, for example a rubber or elastomer material.

The housing comprises a one-piece housing shell in which a structural unit is accommodated that comprises at least one receiver. The housing shell is made from a rigid material and produced as a standard part not adapted to an individual.

According to the invention, the housing shell on the one hand has a first, front-side opening, which is closed with a face plate. On the other hand, the housing shell has a second, rear-side opening lying approximately opposite the first opening, wherein the structural unit comprising the receiver protrudes from the rear-side opening with a retainer stub, and wherein the structural unit is fixed on the housing shell by a securing ring mounted externally (i.e. from outside the housing shell) onto the retainer stub. The retainer stub has a sound channel which passes through it, in particular centrally, and by which sound that is generated by the receiver is conveyed into the auditory canal of the user.

When the housing of the hearing device is correctly inserted in the auditory canal of a user, the front-side opening of the housing shell is directed toward the auricle, while the rear-side opening is directed toward the eardrum.

To assemble the hearing device according to the invention, the structural unit comprising the receiver is inserted through the front-side opening of the housing shell into a housing interior enclosed by the housing shell, wherein the retainer stub is pushed outward from the housing interior through the rear-side opening. The securing ring is then fitted onto the retainer stub protruding from the rear-side opening, such that the structural unit is fixed on the housing shell. The structural unit is expediently prefabricated outside the housing shell before being fitted.

The one-piece housing shell means that, by comparison with conventional hearing devices, the housing of the hearing device according to the invention can advantageously be produced more easily and in a shorter time and therefore in particular at less cost. It is of particular advantage that the housing shell of the hearing device according to the invention does not have to be bonded or welded. A further advantage is that, by virtue of its one-piece configuration, the housing shell is particularly robust and affords particular reliability against mechanical failure. Since the structural unit comprising the receiver is also not bonded or welded in the housing shell, it can advantageously be dismantled without destruction and thus advantageously facilitates an exchange of the receiver, for example for repair purposes or for adjustment.

In a preferred embodiment, the structural unit comprising the receiver moreover comprises a ring antenna (antenna coil) for wireless data transmission by means of magnetic induction. The wireless data transmission serves, for example, for communication with a remote control or (in the case of a binaural aid) for communication with a second hearing device. In a preferred arrangement, the ring antenna is interposed between the receiver and the retainer stub, wherein the ring antenna in particular engages circumferentially about the sound channel routed in the retainer stub. In this case too, the structural unit is preferably pre-assembled as a fixedly interconnected structural unit outside the housing shell before being fitted.

In a particularly preferred embodiment, the retainer stub is provided with an outer thread, wherein the securing ring is provided with a corresponding inner thread. In this embodiment, the securing ring is thus configured as a threaded ring that can be screwed onto the retainer stub. In this way, the structural unit can be fixed particularly easily in the housing shell, wherein a connection is advantageously obtained that can be disengaged particularly easily. The securing ring is preferably secured against automatic release with the aid of a screw fastening, preferably with a mechanical screw fastening. For example, the rear-side opening of the housing shell has a sawtooth contour which meshes into the screwed-on and tightened securing ring.

In an alternative but likewise advantageous embodiment, the securing ring is fastened on the retainer stub by another force-fit and/or form-fit connection. In one embodiment, for example, the securing ring is fixed on the retainer stub by means of a snap-fit connection or latching connection. Additionally or alternatively, retainer pins are used to fix the securing ring.

In one embodiment, the retainer stub has a connection element onto which the retainer dome is plugged or can be plugged with a corresponding connection element. The connection element has in particular a ball-joint head, onto which can be plugged the retainer dome with a corresponding joint socket. In the assembled state, the connection element is expediently arranged beyond the securing ring, i.e., during assembly of the structural unit, the securing ring is mounted onto the retainer stub beyond the connection element.

In an alternative embodiment, the securing ring has a connection element onto which the retainer dome is plugged or can be plugged with a corresponding connection element. In this case too, the connection element preferably has a ball-joint head. When the connection element is arranged on the securing ring, it can advantageously be removed particularly easily from the hearing device housing, for example for repair purposes or for cleaning. Moreover, the connection element can be particularly easily exchanged, for example in the event of a defect, or if a change is to be made to another connecting method. Additionally or alternatively, the securing ring comprises a cerumen filter which serves to protect the sound channel from entry of dirt. It is also advantageously possible for the cerumen filter to be cleaned or exchanged in a particularly simple way, by means of the securing ring being dismantled and, if appropriate, exchanged.

Irrespective of whether the connection element is arranged on the retainer stub or on the securing ring, it can in both cases be produced in several ways. In one embodiment, the connection element and the retainer stub or securing ring are produced in one piece (as a monolithic structure). For example, the connection element and the retainer stub or securing ring are produced jointly as an injection-molded part, for example from a plastic. In a further variant, the connection element and the retainer stub or securing ring are produced in one piece from metal. In a further variant, the connection element is produced from metal, while the retainer stub or securing ring is produced from plastic, wherein the metallic connection element is in particular encapsulated by the plastic.

Irrespective of whether the connection element is arranged on the retainer stub or on the securing ring, alternative configurations of the connection element are also conceivable.

Since the securing ring is intended to be arranged in the auditory canal of a user in a position facing toward the eardrum, it is particularly important that it is reliably fixed on the housing shell, specifically on the retainer stub. Therefore, in one embodiment, the securing ring is assigned a protection device which serves to block a functioning operation of the hearing device if the securing ring is fitted incorrectly. If the hearing device is blocked by the protection device, i.e. the hearing device does not function, then the user will check for the correct fit of the securing ring. By comparatively simple means, the user is advantageously reliably informed when the securing ring is not fitted correctly on the retainer stub and when there is therefore the risk of the securing ring coming loose in the auditory canal of the user.

The protection device is preferably mechanical and/or electrical.

In a variant of the protection device, the securing ring is coupled mechanically to a battery flap of the hearing device, such that the battery flap can be closed only if the securing ring is fitted correctly. With the battery flap opened, the voltage supply to the hearing device is interrupted in a conventional manner, such that the operation of the hearing device is thereby blocked.

In a further variant of the protection device, the securing ring is assigned an electrical contact which is closed only if the securing ring is fitted correctly, such that in this case too the voltage supply to the hearing device is interrupted if the securing ring is fitted incorrectly.

In one embodiment, the securing ring, in addition to its main function of fixing the structural unit, has an additional function. The additional function can be a switch function for example, which can be actuated by means of the securing ring. The additional function is preferably an on/off switch function, which is realized in particular by an electrical contact which is closed or opened in a defined position of the securing ring. The switching on and off of the hearing device is advantageously simplified for the user. Conventional hearing devices are usually switched on and off by closing or opening the battery compartment. It is known that the battery compartment can be quite easily damaged as a result. This danger is advantageously not seen in the switching of and off by means of the securing ring. Additionally or alternatively, the securing ring is set up and used to adjust different hearing device programs.

The use of the securing ring as a switch element is particularly preferable in the case of a securing ring that is snapped on in order to mount the structural unit rotatably onto the retainer stub.

In addition or alternatively, the additional function serves as a side indication for the hearing device. The side indication is realized in particular by a color coding of the securing ring.

The face plate is preferably fastened to the housing shell with the aid of a latching connection, such that the entire production of the hearing device housing takes place without a bonding step. This advantageously contributes to the uncomplicated and cost-effective assembly of the hearing device. Additionally or alternatively, the face plate is screwed onto the housing shell or fastened to the housing shell with the aid of retainer pins. The face plate is preferably adapted in terms of its dimensions to the front-side opening of the housing shell such that, after its assembly, it advantageously no longer has to be cut to size, as is customarily the case.

Other features which are considered as characteristic for the invention are set forth in the appended claims.

Although the invention is illustrated and described herein as embodied in hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Parts that correspond to one another are labeled with the same reference signs throughout the figures.

DETAILED DESCRIPTION OF THE INVENTION

Figure 1:
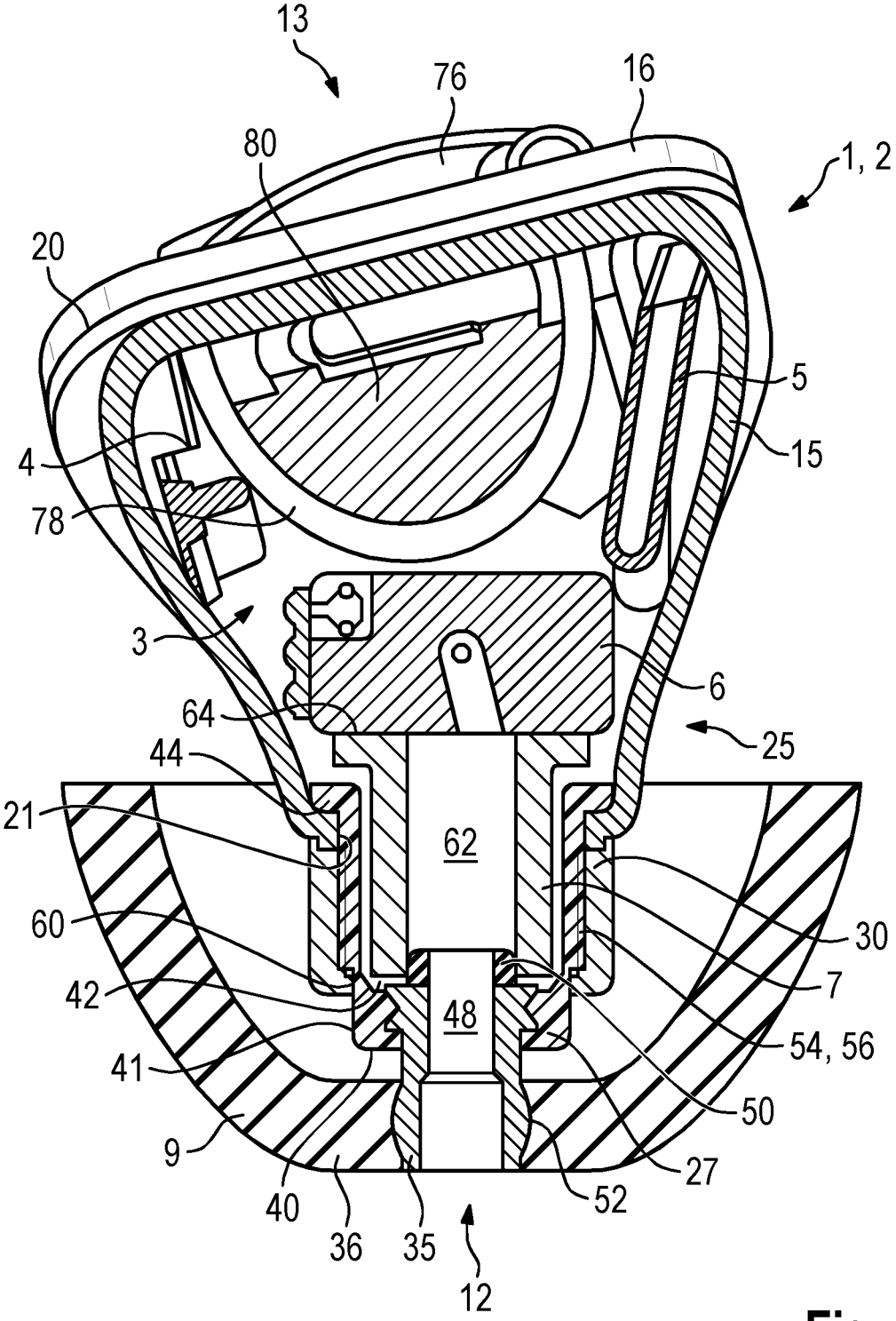
FIG. 1 shows a cross-sectional view of a hearing device, comprising a one-piece housing shell which is closed by a face plate and in which a structural unit comprising a receiver and a ring antenna is received, said structural unit being fixed by a securing ring which is fitted onto a retainer stub of the structural unit protruding from the housing shell, wherein the retainer stub has a connection element for the mounting of a flexible retainer dome.

Referring now to the figures of the drawing in detail and first, particularly, to FIG. 1 thereof, there is shown a hearing device 1 which comprises a housing 2 for accommodating hearing device components. The view shows a longitudinal section through the hearing device 1, such that a housing interior 3 enclosed by the housing 2 is visible, as also are the hearing device components accommodated wholly or partially therein, including a microphone 4, a signal processor 5, a receiver 6, and an annular induction coil or ring antenna 7.

The hearing device 1 is an in-the-ear hearing device to be worn in the auditory canal and designed as an instant-fit device. The housing 2 is accordingly produced as a standard part, i.e. is not custom made, wherein the hearing device 1 comprises a flexible retainer dome 9 which is fitted releasably onto the housing 2. The retainer dome 9, produced from silicone for example, serves to fix the housing 2 in the auditory canal of a person wearing the hearing device, i.e. the user. The retainer dome 9 is only indicated schematically here. The retainer dome 9 is typically designed as a replacement or exchange part that is separate (detached or detachable) from the housing 2. Such retainer domes are conventionally referred to as, for example, click domes, click sleeves or ear molds.

With the hearing device 1 correctly inserted, a side of the housing 2 referred to as the rear side 12 is directed toward the eardrum of the user, while a side of the housing 2 referred to as the front side 13 is correctly directed toward the auricle.

The housing 2 comprises a one-piece housing shell 15, and also a face plate 16 for closing the housing shell 15.

The housing shell 15 has in rough outline a hose-like shape which tapers toward the rear side 12. The housing shell 15 has a first, front-side (assembly) opening 20 and, lying approximately opposite the latter, a second, rear-side (assembly) opening 21. The front-side opening 20 serves for the insertion of the hearing device components into the housing shell 15.

The rear-side opening 21 serves for the assembly of the receiver 6 and of the ring antenna 7. For this purpose, the hearing device 1 comprises a structural unit 25 which for its part comprises a retainer stub 27, or mounting stub, protruding from the opening 21, wherein the ring antenna 7 is received in the retainer stub 27, and wherein the receiver 6 is fixed on the ring antenna 7. A securing ring 30 mounted on the retainer stub 27 from the direction of the rear side 12 serves to fix the structural unit 25 on the housing shell 15.

Furthermore, the retainer stub 27 has a connection element 35 which is arranged outside the housing 2 and which corresponds to a connection element 36 of the retainer dome 9, such that the retainer dome 9 can be clicked onto the housing 2, specifically onto the connection element 35 of the retainer stub 27.

Figure 2:
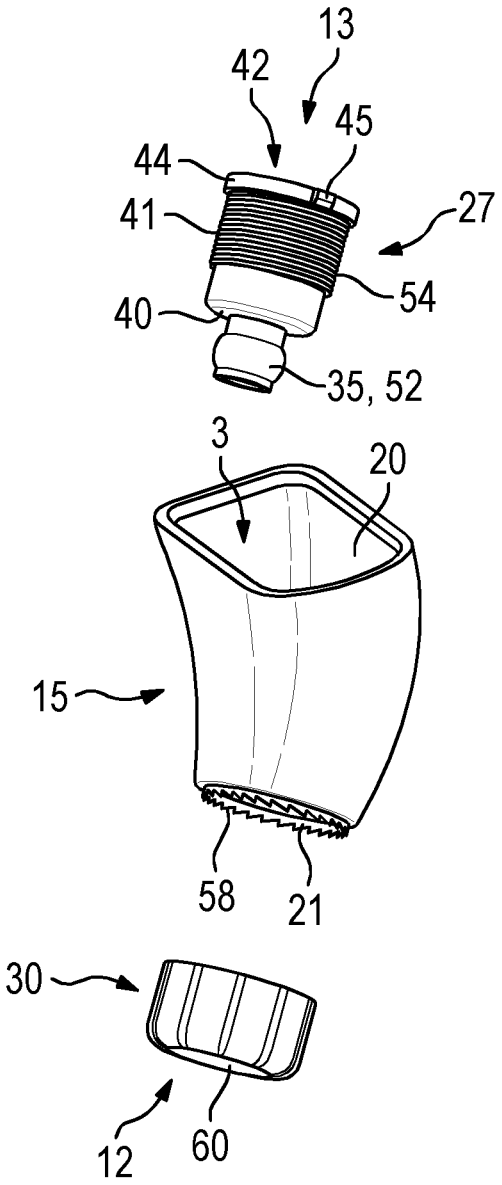
FIG. 2 shows an exploded view of the housing shell, the retainer stub and the securing ring according to FIG. 1.

The construction and the assembly of the structural unit 25 is explained in more detail below with reference to FIG. 1 and FIG. 2.

The retainer stub 27 is produced as a pot-like or beaker-shaped component made of plastic. The retainer stub 27 accordingly comprises a flat bottom 40, and a peripheral wall 41 which adjoins the bottom 40 and which encloses a hollow-cylindrical stub interior 42. The diameter of the retainer stub 27 corresponds approximately to the diameter of the opening 21. A peripheral, radially outwardly protruding limit stop 44 is integrally formed on an edge of the peripheral wall 41. In the assembled state, the retainer stub 27 sits in the opening 21, wherein the greater part of it protrudes from the housing shell 15 and, in the housing interior 3, bears with the limit stop 44 on an edge of the housing shell 15 surrounding the opening 21. At one location, a likewise radially outwardly protruding retainer lug 45 is formed from the limit stop 44 and, in the assembled state, acts as an anti-rotation means for the retainer stub 27.

A circular (sound) opening 48 is formed centrally into the bottom 44 of the retainer stub 27 and is enclosed by a collar 50 protruding vertically toward the stub interior 42. Toward the outside, the opening 48 is adjoined by the connection element 35. The connection element 35 is a short tube section made of metal which is oriented coaxially with the retainer stub 27, wherein the tube section is flush with the opening 48. At a first longitudinal end, the connection element 35 is formed into the bottom 40 of the retainer stub 27 with the aid of circumferential ribs. At its second longitudinal end, the internal diameter of the connection element 35 widens in one step. In this region, the outer surface of the connection element 35 is bulged outward to form a ball-joint head 52. The connection element 35 is accordingly also referred to as a ball spout.

On an outer face of the peripheral wall 41, the retainer stub 27 has an outer thread 54 onto which the securing ring 30 is screwed 9 from the outside of the housing 2 in order to fix the retainer stub 27 on the housing shell 15. For this purpose, the securing ring 30 is provided with an inner thread 56 adapted to the outer thread 54. The securing ring 30 is secured against coming loose automatically. In the illustrative embodiment, the opening 21 is for this purpose provided with a sawtooth contour 58 which is directed toward the securing ring 30 and which, through its barb structure, acts as a mechanical screw fastening and arrester for the tightened securing ring 30 (see in particular FIG. 2), similar to a ratchet device.

On the outside, the securing ring 30 has longitudinal ribs which serve for fitting the securing ring 30 with the aid of a tool wrench. In the assembled state, the securing ring 30 bears sealingly on the retainer stub 27 with a radially inwardly protruding sealing edge 60. The outer face of the peripheral wall 41 in this case acts as a sealing face in a section near the bottom. However, the sealing of the housing interior 3 against contamination (humidity, perspiration, earwax) is provided predominantly by a surface pressure resulting from the screwing of the retainer stub 27 in the housing shell 15, which surface pressure acts in particular between the limit stop 44 and the edge surrounding the opening 21.

The securing ring 30 is optionally colored in order to identify the side of the head for which the hearing device is intended (for example red for the right-hand side and blue for the left-hand side).

The ring antenna 7 is inserted into the stub interior 42 of the retainer stub 27, wherein both parts are oriented at least approximately coaxially. The ring antenna 7 is configured as a cylindrical hollow body that is open at both longitudinal ends. At its first longitudinal end, the ring antenna 7 lies with its internal diameter on the collar 50 enclosing the opening 48. The ring antenna 7 is bonded with silicone in the retainer stub 27. The silicone also serves here for the acoustic sealing of a sound channel 62 routed in the interior of the ring antenna 7. At its second longitudinal end, the external diameter of the ring antenna 7 widens radially outward in one step, such that an end face 64 of the ring antenna 7 is enlarged.

The receiver 6 is bonded to the end face 64 of the ring antenna 7, such that the sound generated by the receiver 6 is conveyed into the sound channel 62. A thin copper foil is bonded between the receiver 6 and the ring antenna 7, by means of which thin copper foil the ring antenna 7 is magnetically shielded from the receiver 6. A plastic or rubber hose of the kind customarily provided between the receiver 6 and the ring antenna 7 is dispensed with in this case.

To assemble the structural unit 25, the ring antenna 7 is first of all bonded to the receiver 6 (and to the copper foil), and the ring antenna 7 is then bonded in the retainer stub 27. The pre-assembled structural unit 25 is then introduced as a whole (as can be seen in particular from the view of the retainer stub 27 in FIG. 2) through the opening 20 into the housing interior 3 of the housing 2 or of the housing shell 15. The retainer stub 27, with the connection element 35 and the bottom 40 toward the front, is plugged through the opening 21 and then fixed from the outside with the aid of the securing ring 30.

Figure 3:
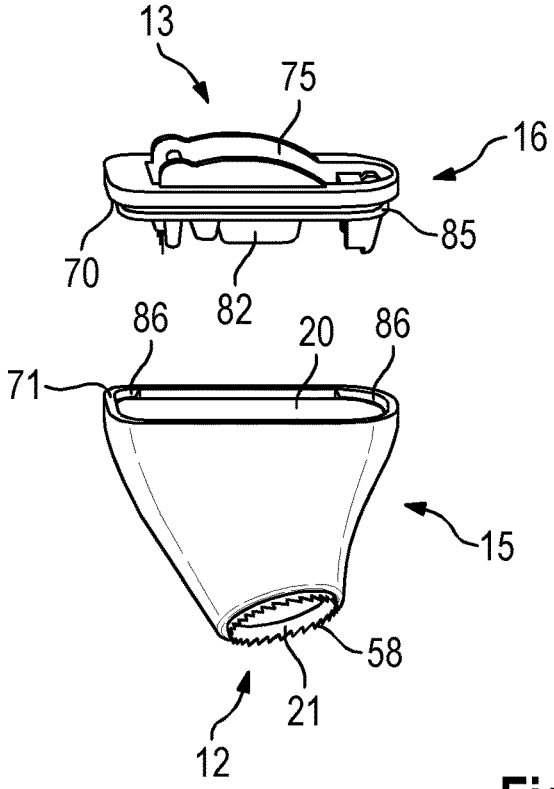
FIG. 3 shows the housing shell and the face plate according to FIG. 1, again in an exploded view.

For the further assembly of the hearing device, the other hearing device components (specifically the microphone 4 and the signal processor 5) are mounted in the customary manner on the face plate 16 and, after they have been wired (and after further components such as battery contacts, programming contacts, receiver 6, ring antenna 7, etc., have been wired), the face plate 16 is fitted onto the opening 20 of the housing shell 15 (cf. FIG. 3).

It will be seen from FIG. 1 and FIG. 3 that the opening 20 extends across the entire front side 13 of the housing shell 15. The face plate 16 is adapted in terms of its shape and size to the here approximately oval contour of the opening 20. In the assembled state of the housing 2, an abutment surface 70 of the face plate 16, at the peripheral edge of the latter, bears on an abutment surface 71 of the housing shell 15. At its circumference, the face plate 16 ends flush with the front-side opening 20 of the housing shell 15. The face plate 16 does not need to be cut to size in this case.

The face plate 16 comprises a battery opening 75 arranged at the front side, which battery opening 75 can be closed by a pivotable battery flap 76 (cf. FIG. 1). The battery flap 76 has a battery holder 78 in which a battery 80 is held (cf. FIG. 1). Moreover, the face plate 16 comprises electrical contact elements 82 (cf. FIG. 3) which protrude into the housing interior 3 and, with the battery flap 76 closed, produce the electrical contact to the battery 80.

Latching elements are integrally formed on the housing shell 15 and on the face plate 16. In the embodiment shown, the latching elements are formed by a bead-like projection 85 which extends circumferentially on the face plate 16 and snaps onto associated projections 86 formed at the opening 20. By means of the projections 85, 86, the face plate 16 is fixed on the housing shell 15 by a snap-fit action or a click connection.

The face plate 16 is optionally screwed onto the housing shell 15. Additionally or alternatively, the face plate 16 is bonded onto the housing shell 15.

Figure 4:
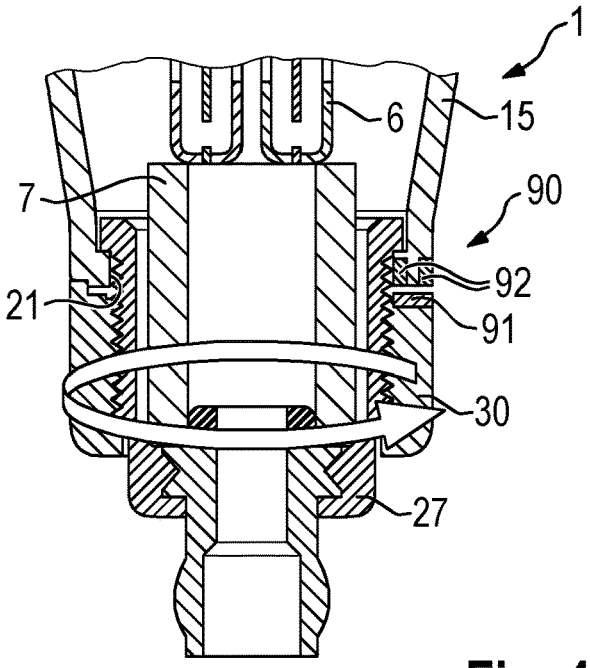
FIG. 4 shows a schematic cross-sectional view of an embodiment of the hearing device according to FIG. 1, with an electrical protection device which blocks the operation of the hearing device when the securing ring is not fitted correctly.
Figure 5:
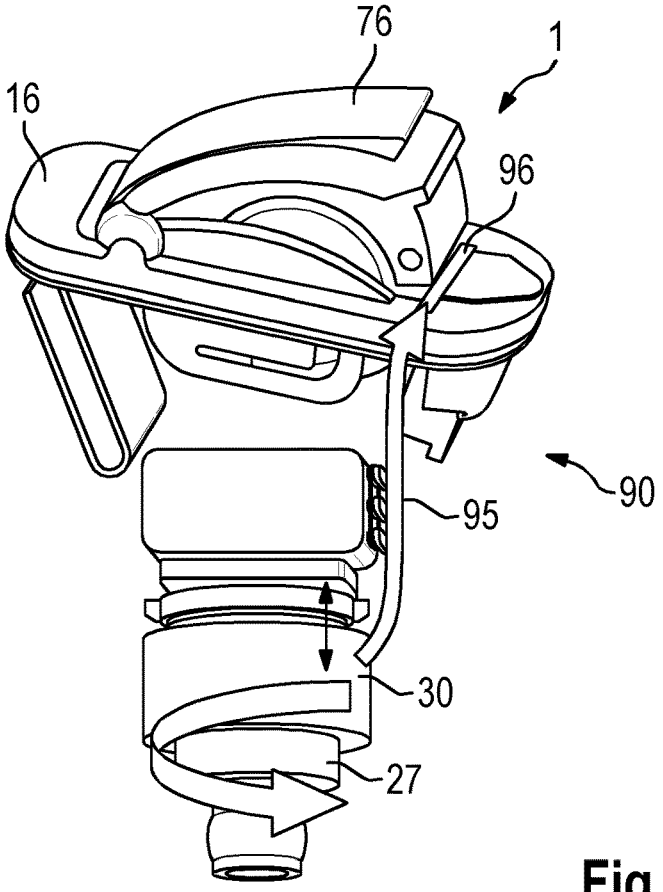
FIG. 5 shows, in a view according to FIG. 4, a further embodiment of the hearing device according to FIG. 1, with a mechanical protection device.

FIG. 4 and FIG. 5 are schematic views illustrating two different design concepts for a protection device 90. The protection device 90 is intended to ensure that the securing ring 30 is mounted correctly on the retainer stub 27, so that there is no danger of the securing ring 30 coming loose from the retainer stub 27 in the auditory canal of the user. The protection device 90 ensures that the hearing device 1 can be operated only when the securing ring 30 is mounted correctly on the retainer stub 27.

According to the embodiment shown in FIG. 4, the protection device 90 comprises a ring-side contact element 91, which is mounted on the securing ring 30, and a housing-side electrical interruption 92, which is arranged on the housing shell 15, specifically on a circumferential edge of the opening 21. The ring-side contact element 91 is configured, for example, as a conductive ring on an end face of the securing ring 30 directed toward the housing shell 15. The housing-side interruption 92 interrupts a circuit that serves to supply current and voltage to the hearing device 1. If the securing ring 30 is drawn sufficiently tight, the interruption 92 is bridged by the contact element 91 and the circuit is closed. This ensures that the hearing device 1 can be operated only when the securing ring 30 is mounted correctly on the retainer stub 27.

According to the embodiment shown in FIG. 5, the protection device 90 comprises a mechanical coupling 95, which couples the securing ring 30 mechanically to a blocking mechanism 96 assigned to the battery flap 76. The coupling 95 and the blocking mechanism 96 are indicated only symbolically here. The mechanical coupling 95 releases the blocking mechanism 96 only when the securing ring 30 is mounted correctly on the retainer stub 27. Otherwise, the battery flap 76 is blocked by the blocking mechanism 96, such that it cannot be closed. However, with the battery flap 76 opened, a circuit ensuring the supply of current to the hearing device 1 is once again interrupted and the hearing device 1 cannot be operated.

In both embodiments (according to FIG. 4 and FIG. 5), the user is led to check for the correct fit of the securing ring 30 if the hearing device 1 is not functioning as it should.

In a development of the embodiment shown in FIG. 4, the contact element 91 and the interruption 92 allow the securing ring 30 to be used as an on/off switch for the hearing device 1. The securing ring 30 is thus assigned the added function of a switch. In an alternative embodiment (not shown here), the securing ring 30 is not screwed onto the retainer stub 27 but instead plugged on with a click fit, such that the securing ring 30 is mounted rotatably. In this case, the contact element 91 bridges the interruption 92 only in a defined rotational position of the securing ring 30. (The contact element 91 in this case extends only over a defined portion of the circumference of the securing ring 30.)

The securing ring 30 is optionally used as a control element for exchange between different hearing device modes, etc.

The switch function of the securing ring 30 is embodied, for example, by an injection-molded circuit carrier (molded interconnect device (MID)) or by a reed contact, i.e. by a switch that is actuatable by a magnetic field.

Figure 6:
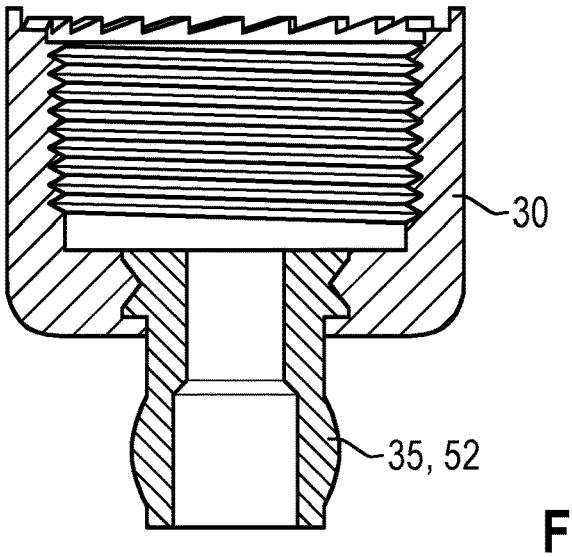
FIG. 6 shows a schematic separate view of the securing ring according to FIG. 1 in an embodiment in which the connection element for the mounting of the retainer dome is integrated in the securing ring.

FIG. 6 shows the securing ring 30 in an alternative embodiment largely corresponding to the above embodiments. However, in contrast to the above embodiments, the connection element 35 is here arranged on the securing ring 30. The connection element 35 is likewise configured substantially analogously to the above embodiments and has in particular the ball-joint head 52. When the securing ring 30 is screwed on, the connection element 35 is flush with the sound channel 62 (as shown in FIG. 1).

In the embodiment shown, the connection element 35 is produced from metal and is embedded, in an injection molding process, into the securing ring 30, which is produced from plastic.

Alternatively, connection element 35 and securing ring 30 are produced in one piece (monolithic structure), for example as an injection-molded part made of plastic or as a turned part made of metal.

In one embodiment, a cerumen filter (not shown here) is optionally integrated in the securing ring 30 and prevents entry of dirt, in particular cerumen (earwax), into the sound channel 62.

The invention will be particularly clear from the illustrative embodiments described above, but it is not limited to these illustrative embodiments. On the contrary, further embodiments of the invention can be derived from the claims and from the above description. In particular, the properties and features of the above-described embodiments can be transferred also to other types of hearing device, in particular to a BTE/RIC hearing device.

The following is a summary list of reference numerals and the corresponding structure used in the above description of the invention:

1 hearing device
2 housing
3 housing interior
4 microphone
5 signal processor
6 receiver
7 ring antenna
9 retainer dome
12 rear side
13 front side
15 housing shell
16 face plate
20 (assembly) opening
21 (assembly) opening
25 structural unit
27 retainer stub
30 securing ring
35 connection element
36 connection element
40 bottom
41 peripheral wall
42 stub interior
44 limit stop
45 retainer lug
48 (sound) opening
50 collar
52 ball-joint head
54 outer thread
56 inner thread
58 screw fastening, sawtooth contour
60 sealing edge
62 sound channel
64 end face
70 abutment surface
11 abutment surface
75 battery opening
76 battery flap
78 battery holder
80 battery
82 contact elements
85 protrusion
86 protrusion
90 protection device
91 contact element
92 interruption
95 coupling
96 blocking mechanism

The invention claimed is:

1. A hearing device, comprising:

a housing configured for insertion into an auditory canal of a person wearing the hearing device;

said housing having a one-piece housing shell formed with a first, front-side opening and a second, rear-side opening substantially opposite said front-side opening, and a face plate closing said front-side opening;

a structural unit including a receiver disposed in said housing shell, said structural unit having a pot-shaped retainer stub having a peripheral wall protruding from said rear-side opening;

a securing ring being mounted to structural unit by a threaded connection on the peripheral wall, said securing ring fixing said structural unit on said housing shell; and a flexible retainer dome releasably fastened to said housing and configured to support said housing in the auditory canal.

2. The hearing device according to claim 1, comprising:

a protection device associated with said securing ring and configured for blocking a functioning operation of the hearing device when said securing ring is fitted incorrectly.

3. The hearing device according to claim 1, wherein said structural unit comprises a ring antenna for wireless data transmission by magnetic induction.

4. The hearing device according to claim 1, wherein said retainer stub is formed with an outer thread and said securing ring is formed with a corresponding inner thread.

5. The hearing device according to claim 4, which comprises a screw fastening for securing said securing ring against unintended release.

6. The hearing device according to claim 1, wherein said retainer stub has a connection element onto which said retainer dome is pluggable with a corresponding connection element.

7. The hearing device according to claim 1, wherein said securing ring has a connection element onto which said retainer dome is pluggable with a corresponding connection element.

8. The hearing device according to claim 2, wherein said protection device is at least one of a mechanical or electrical device.

9. The hearing device according to claim 2, which comprises a battery flap, and wherein said securing ring is mechanically coupled to said battery flap, such that said battery flap cannot be closed when said securing ring is fitted incorrectly.

10. The hearing device according to claim 2, wherein said securing ring is assigned an electrical contact that is opened if said securing ring is fitted incorrectly, such that a voltage supply to the hearing device is interrupted when said securing ring is fitted incorrectly.

11. The hearing device according to claim 1, wherein said securing ring, in addition to the function of fixing said structural unit, is configured to perform an additional function.

12. The hearing device according to claim 1, wherein said face plate is fastened to said housing shell by way of a latching connection.

13. The hearing device according to claim 1, wherein said peripheral wall has a stop on an outer edge thereof, said stop bears on an edge of the housing shell surrounding said rear-side opening.

14. The hearing device according to claim 13, wherein said stop has an radially outwardly protruding anti rotation lug disposed thereon.

* * * * *